US006469442B2

(12) United States Patent
Kakisaka et al.

(10) Patent No.: US 6,469,442 B2
(45) **Date of Patent: *Oct. 22, 2002**

(54) METAL VAPOR DISCHARGE LAMP

(75) Inventors: Shunsuke Kakisaka; Shigefumi Oda; Shiki Nakayama; Takashi Yamamoto, all of Osaka; Hiroshi Nohara, Hyogo, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/578,142

(22) Filed: May 24, 2000

(65) Prior Publication Data

US 2002/0101160 A1 Aug. 1, 2002

(30) Foreign Application Priority Data

May 25, 1999 (JP) ..... 11-144692

(51) Int. Cl.[7] ..... H01J 61/073

(52) U.S. Cl. ..... 313/634; 313/620; 313/623; 313/624

(58) Field of Search ..... 313/333, 623, 313/624, 634, 570, 573, 620, 331, 625

(56) References Cited

U.S. PATENT DOCUMENTS 2,765,420 A 10/1956 Martt (List continued on next page.)

FOREIGN PATENT DOCUMENTS

| | | |
|---|---|---|
| EP | 0 286 247 | 12/1988 |
| EP | 0 639 853 | 2/1995 |
| EP | 1 056 115 | 5/1999 |

(List continued on next page.)

*Primary Examiner*—Ashok Patel
(74) *Attorney, Agent, or Firm*—Merchant & Gould P.C.

(57) ABSTRACT

A metal vapor discharge lamp includes a discharge tube comprising a translucent ceramic discharge portion that defines a discharge space in which a luminous metal is sealed, slender tube portions provided on both ends of the discharge portion, a pair of electrodes provided with coils at the tips thereof, electrode supports that support the electrodes at one end thereof and extend all the way to the ends of the slender tube portions on the side opposite to the discharge space at the other end thereof, and a sealant for sealing the ends of the slender tube portions on the side opposite to the discharge space so as to attach the electrode supports to the inner surfaces of the slender tube portions, in which $X>0.0056P+0.394$ is satisfied, where P is a lamp power (W) and X is a distance (mm) from the ends of the coils on the side of the slender tube portions to the ends of the slender tube portions on the side of the discharge space.

4 Claims, 6 Drawing Sheets

U.S. PATENT DOCUMENTS

| | | | | | |
|---|---|---|---|---|---|
| 4,105,908 | A | | 8/1978 | Harding et al. | |
| 4,475,061 | A | | 10/1984 | van de Weijer et al. | |
| 4,539,511 | A | | 9/1985 | Denbigh et al. | |
| 4,651,048 | A | | 3/1987 | Liebe | |
| 4,808,881 | A | | 2/1989 | Kariya et al. | |
| 4,910,430 | A | | 3/1990 | Ito et al. | |
| 5,357,167 | A | | 10/1994 | Mathews et al. | |
| 5,424,609 | A | | 6/1995 | Geven et al. | |
| 5,552,670 | A | | 9/1996 | Heider et al. | |
| 5,557,169 | A | * | 9/1996 | Van Lierop et al. | 313/624 X |
| 5,654,606 | A | | 8/1997 | Weijtens et al. | |
| 5,680,000 | A | | 10/1997 | Zuk et al. | |
| 5,708,328 | A | | 1/1998 | Mathews et al. | |
| 5,742,124 | A | | 4/1998 | Kees et al. | |
| 5,742,125 | A | | 4/1998 | Ruigrock | |
| 5,751,111 | A | * | 5/1998 | Stoffels et al. | 313/620 X |
| 5,856,726 | A | | 1/1999 | Evans et al. | |
| 5,905,341 | A | | 5/1999 | Ikeuchi et al. | |

FOREIGN PATENT DOCUMENTS

| | | |
|---|---|---|
| JP | 55-136449 | 10/1980 |
| JP | 58-59555 | 4/1983 |
| JP | 60-63869 | 4/1985 |
| JP | 61-245457 | 10/1986 |
| JP | 62-283543 | 12/1987 |
| JP | 6-89699 | 3/1994 |
| JP | 6-196131 | 7/1994 |
| JP | 7-21981 | 1/1995 |
| JP | 7-21983 | 1/1995 |
| JP | 7-94142 | 4/1995 |
| JP | 7-240184 | 9/1995 |
| JP | 9-92204 | 4/1997 |
| JP | 9-129178 | 5/1997 |
| JP | 10-134768 | 5/1998 |
| JP | 11-96973 | 4/1999 |
| JP | 2000-285849 | 10/2000 |

* cited by examiner

METAL VAPOR DISCHARGE LAMP

BACKGROUND OF THE INVENTION

1. Field of the Invention

The present invention relates to a metal vapor discharge lamp, in particular, a metal vapor discharge lamp using an alumina ceramic discharge tube.

2. Description of the Prior Art

In recent years, in the field of metal halide lamps, it has been increasingly common that alumina ceramic is used as a material for a discharge tube in place of a conventional material of quartz glass. Since alumina ceramic is more excellent in heat-resistance than quartz glass, alumina ceramic is suitable for a discharge tube of a high pressure discharge lamp whose temperature becomes high during lighting. For this reason, a metal halide lamp using an alumina ceramic discharge tube can achieve high color rendering properties and high efficiency. Moreover, alumina ceramic has a lower reactivity with a metal halide that is sealed in the discharge tube than that of quartz glass, so that it is expected to contribute to further prolongation of the lifetime of the metal halide lamp.

For all the metal halide lamps using alumina ceramic discharge tubes that are commercially available at present, the limit of the electric power is 150W or less. In the future, when the lamp is used at a higher wattage, a problem may arise in the reliability of the sealing portion structure.

More specifically, the thermal expansion coefficient of tungsten or molybdenum that is used for a halide resistant portion of a feeding member inside a slender tube portion is significantly different from that of alumina. Therefore, in high-wattage lamps where the temperature of the discharge tube is further increased, cracks are generated in the sealing portion when the lamp is on, and leaks may occur in the discharge tube.

In order to achieve long life-time in the high-wattage lamps, use of a conductive cermet whose thermal expansion coefficient is substantially equal to that of alumina ceramic for the feeding member has been considered.

The electrodes of a lamps of this type are sealed, not by heating and pressing the side tube portions of the discharge tube, as in the case where quartz glass is used, but by melting a sealant such as frit glass and flowing the molten sealant therein. Therefore, in the portions that are not sealed with the sealant, a gap between the feeding member and the inner surface of the slender tube portion is generated (see JP-57-78763 A). Moreover, a high wattage lamp has a large discharge tube, and the larger the discharge tube is, the larger the gap becomes.

As described above, in the conventional metal halide lamp using alumina ceramic for the discharge tube, a gap is present between the feeding member and the inner surface of the slender tube portion. Therefore, when the lamp is turned on with the electrodes of the lamp being oriented in the vertical direction, luminous metal sealed inside the discharge tube tends to fall down into the gap between the feeding member and the inner surface of tile slender portion.

During the life of the lamp, when the luminous metal falls down into the gap, the metal contributes less to luminescence in the discharge space, so that sufficient vapor pressure cannot be obtained, and color temperature is changed significantly. In other words, even if the color temperature characteristics are sufficient immediately after the lamp turns on, the characteristics may be changed significantly, for example 100 hours after the lamp turns on. When the amount of the luminous metal sealed is increased in order to prevent this problem, the reaction between the luminous metal and the electrodes and the alumina is accelerated, so that the life-time characteristics deteriorate.

SUMMARY OF THE INVENTION

Therefore, with the foregoing in mind, it is an object of the present invention to provide a metal vapor discharge lamp that has little color temperature change during continuous lighting for a long period and maintains stable characteristics by reducing the amount of the luminous metal that falls down into the slender tube portion.

In order to achieve the above object, a metal vapor discharge lamp of the present invention includes a discharge tube comprising a translucent ceramic discharge portion that defines a discharge space in which a luminous metal is sealed, slender tube portions provided on both ends of the discharge portion, a pair of electrodes provided with coils at the tips thereof, electrode supports that support the electrodes at one end and extend all the way to the ends of the slender tube portions on the side opposite to the discharge space at the other end thereof, and a sealant for sealing the ends of the slender tube portions on the side opposite to the discharge space so as to attach the electrode supports to the inner surfaces of the slender tube portions, wherein $X>0.0056P+0.394$ is satisfied, where P is a lamp power (W) and X is a distance (mm) from the ends of the coils on the side of the slender tube portions to the ends of the slender tube portions on the side of the discharge space.

In this embodiment, the distance X from the tips of the electrodes including high-temperature positive columns and coils to the end of the slender tube portion on the side of the discharge space is set at a value that satisfies the above equation, so that the temperature in the vicinity of the end faces of the slender tube portions on the side of the discharge space can be kept at a temperature at which excessive luminous metal is liquid.

Thus, in the case where this metal vapor discharge lamp is turned on with the electrodes being oriented to the vertical direction, the amount of the luminous metal that falls down into the slender tube portion can be reduced from that in conventional lamps. As a result, the present invention can provide a metal vapor discharge lamp that keeps sufficient vapor pressure in the discharge space, allows little color temperature change in continuous lighting for a long period of time, and maintains stable characteristics.

In the above metal vapor discharge lamp, it is preferable that the sealant extends from the ends of the slender tube portions on the side opposite to the discharge space into the slender tube portions.

In this embodiment, the sealant is present inside the slender tube portions, so that the volume of the space in the slender tube portions is reduced, and therefore the amount of the luminous metal that falls down into the slender tube portion during lighting is reduced. Thus, this embodiment further suppresses the drop of the vapor pressure inside the discharge space. As a result, the present invention can provide a metal vapor discharge lamp that allows a further reduced color temperature change during continuous lighting for a long period of time, and maintains further stable characteristics.

In the above metal vapor discharge lamp, it is preferable that $L<X\times 20.783P^{-0.0971}$ is satisfied, where L is a distance (mm) from the ends of the slender tube portions on the side of the discharge space to the ends of the sealant on the side of the discharge space.

In the above metal vapor discharge lamp, it is preferable that the slender tube portions are made of the same translucent ceramic as that for the discharge portion, and the electrode supports are made of a conductive cermet having a thermal expansion coefficient substantially equal to that of the translucent ceramic.

In this embodiment, cracks due to the difference in the thermal expansion coefficient hardly are generated during lighting, and leaks in the discharge tube can be prevented. Thus, the present invention can provide a metal vapor discharge lamp having a long lifetime, high color rendering and high efficiency.

As described above, the present invention provides a metal vapor discharge that has a reduced color temperature change during lighting and maintains stable characteristics.

These and other advantages of the present invention will become apparent to those skilled in the art upon reading and understanding the following detailed description with reference to the accompanying figures.

DESCRIPTION OF THE PREFERRED EMBODIMENTS

Hereinafter, an embodiment of the present invention will be described with reference to the accompanying drawings.

Figure 1:
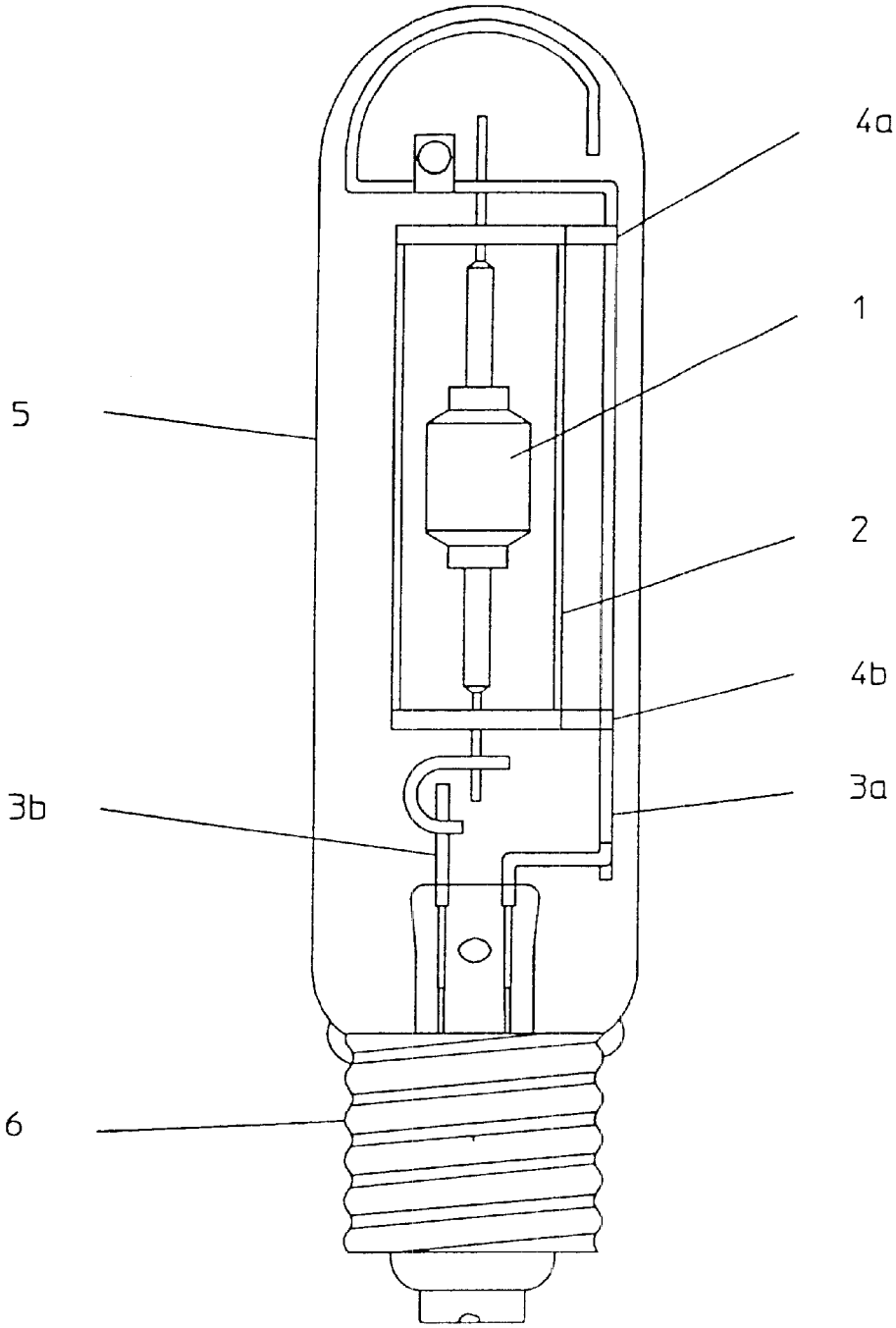
FIG. 1 is a front view of a metal vapor discharge lamp of an embodiment of the present invention.

FIG. 1 is a front view showing the structure of a 250W metal vapor discharge lamp of an embodiment of the present invention. As shown in FIG. 1, the metal vapor discharge lamp of this embodiment includes an alumina ceramic discharge tube 1 held in a predetermined position by lead wires 3*a* and 3*b* in an outer tube 5. Nitrogen is sealed at a predetermined pressure inside the outer tube 5 and a base 6 is mounted in the vicinity of the sealing portion.

The discharge tube 1 is provided inside a sleeve 2 made of quartz glass that is effective in reducing ultraviolet rays. The sleeve 2 made of quartz glass keeps the discharge tube 1 warm and keeps sufficient vapor pressure, and also prevents the outer tube 5 from being broken when the discharge tube 1 is broken. The sleeve 2 made of quartz glass is held onto the lead wire 3*a* by sleeve supporting plates 4*a* and 4*b*.

Figure 2:
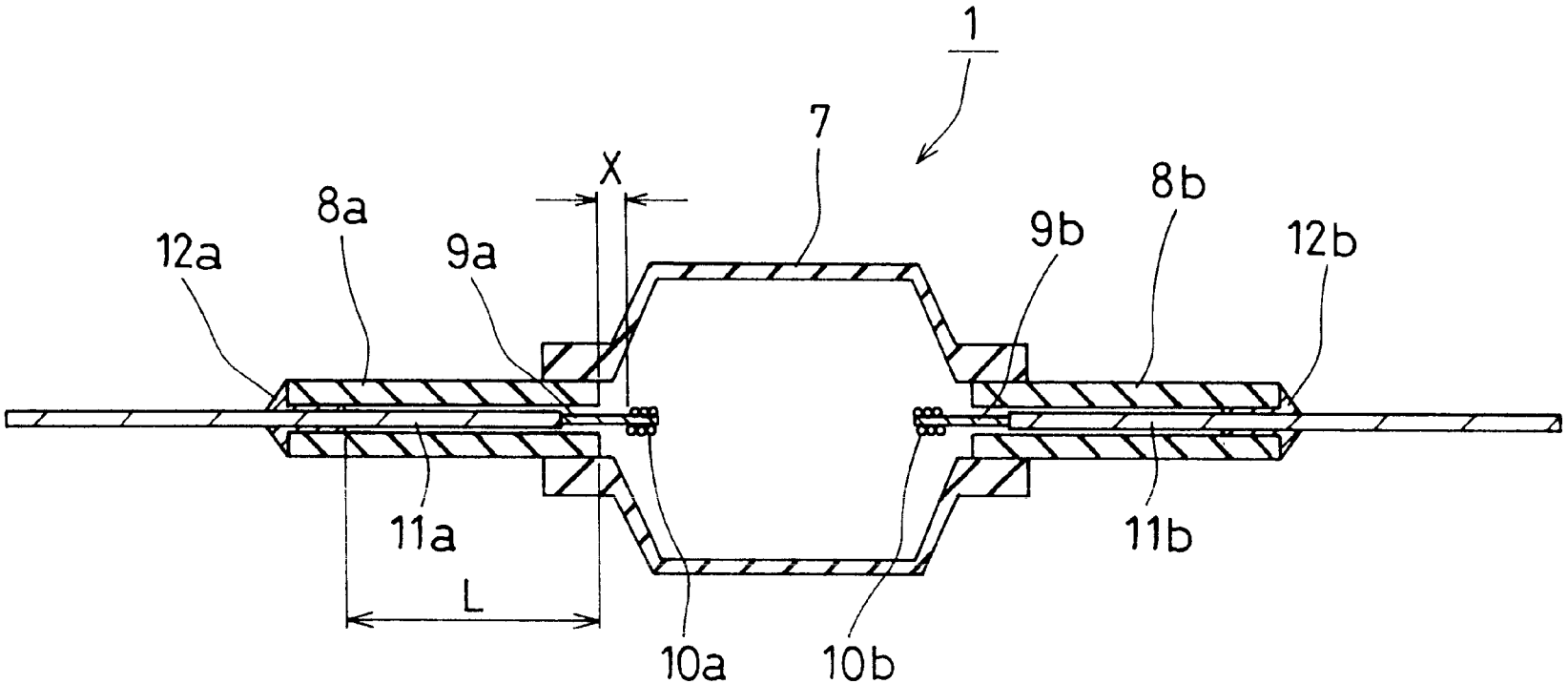
FIG. 2 is a cross-sectional view showing the detail of the structure of a discharge tube provided in the metal vapor discharge lamp of FIG. 1.

FIG. 2 is a cross-sectional view showing the detail of the structure of the discharge tube 1. As shown in FIG. 2, the discharge tube 1 has slender tube portions 8*a* and 8*b* at both ends of a main tube portion (discharge portion) 7, which defines a discharge space. Mercury, rare gas and luminous metal are sealed in the discharge space of the main tube portion 7.

Feeding members including coils 10*a* and 10*b*, electrode pins 9*a* and 9*b*, and conductive cermets (electrode supports) 11*a* and 11*b* are inserted through the slender tube portions 8*a* and 8*b*, respectively. The coils 10*a* and 10*b* are mounted on the tips of the electrode pins 9*a* and 9*b* and are opposed to each other in the discharge space of the main tube portion 7. The electrode pins 9*a* and 9*b* are made of tungsten and have an outer diameter of 0.71 mm and a length of 5.2 mm. The conductive cermets 11*a* and 11*b* are connected to the electrode pins 9*a* and 9*b* and have an outer diameter of 1.3 mm and a length of 30 mm. The inner diameter of the slender tube portions 8*a* and 8*b* is 1.4 mm.

In general, a conductive cermet is produced by mixing metal powder, for example molybdenum or the like, and alumina powder and sintering the mixture. The thermal expansion coefficient thereof is substantially equal to alumina. In this embodiment, the conductive cermets 11*a* and 11*b* are produced by mixing molybdenum and alumina in a composition ratio of 50:50 (wt %) and sintering the mixture, and the thermal expansion coefficient thereof is $7.0\times10^{-6}$.

The conductive cermets 11*a* and 11*b* are projected from the ends of the slender tube portions 8*a* and 8*b* on the side opposite to the side where they are connected to the main tube portion 7. Further, the conductive cermets 11*a* and 11*b* are attached to the inner surfaces of the slender tube portions 8*a* and 8*b* with glass frits 12*a* and 12*b* (sealant) filling the gap therebetween to a predetermined length. The glass frits 12*a* and 12*b* are made of metal oxide, alumina, silica and the like, and are flowed toward the main tube portion 7 in a predetermined length from the end of the slender tube portions 8*a* and 8*b* on the side opposite to the side where they are connected to the main tube portion 7, as described more specifically later.

Figure 3:
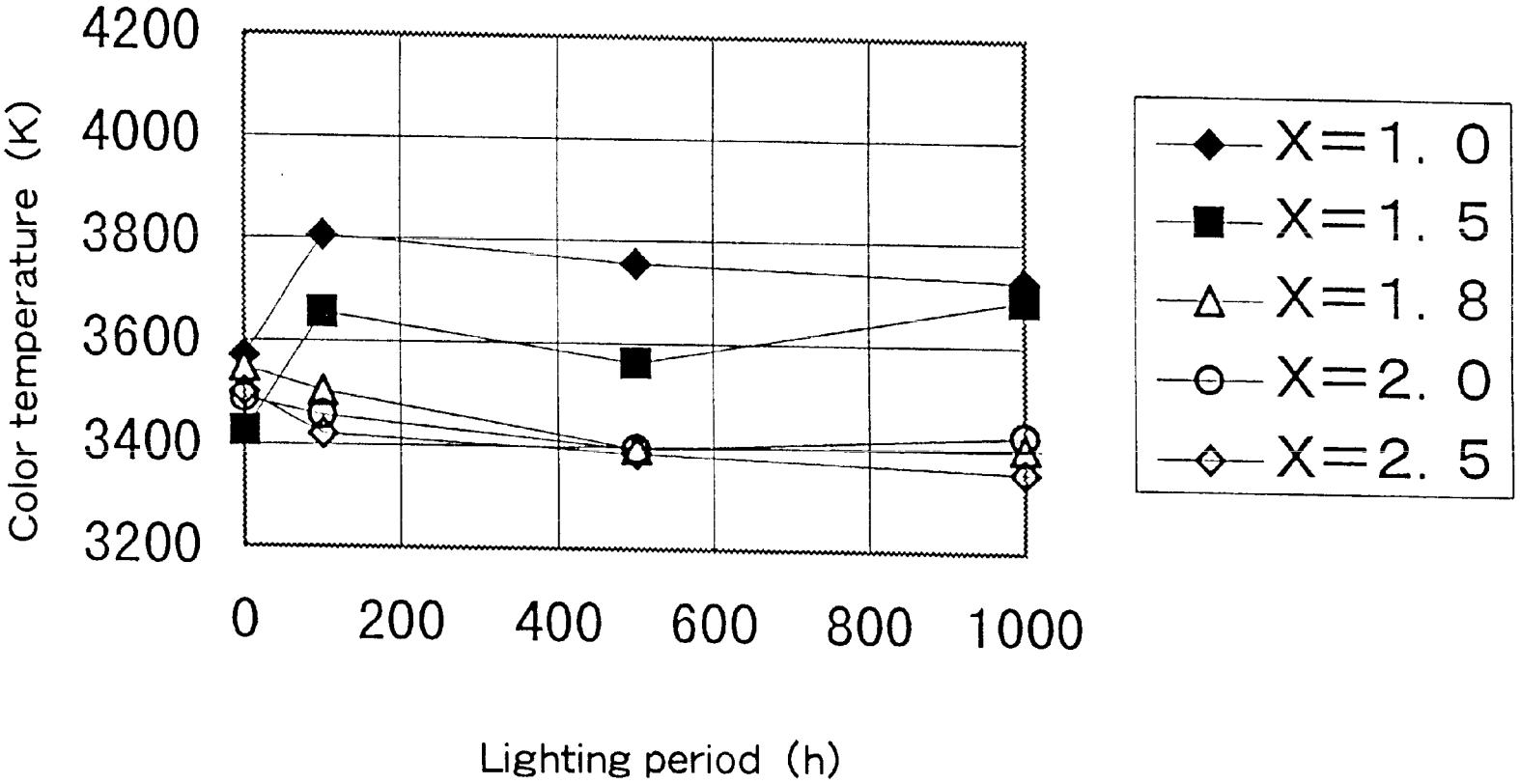
FIG. 3 is a graph showing the color temperature change during lighting when the distance from the end of a coil on the slender tube portion side to the end of the slender tube portion on the discharge space side is changed in the metal vapor discharge lamp (250W) of FIG. 1.

The color temperature change during life in the metal vapor discharge lamp (250W) having the above-described structure was measured for each of the distances X (see FIG. 2) from the ends of the coils 10*a* and 10*b* on the side of the slender tube portions 8*a* and 8*b* to the ends of the slender tube portions 8*a* and 8*b* on the side of the discharge space of 1.0 mm, 1.5 mm, 1.8 mm, 2.0 mm and 2.5 mm. FIG. 3 shows the results.

In all of the cases, the amount of luminous metal sealed in the discharge space was 5.2 mg. The composition was as follows: 0.8 mg of $DyI_3$, 0.6 mg of $HoI_3$, 0.8 mg of $TmI_3$, 2.2 mg of NaI, and 0.8 mg of TlI. Argon with a pressure of 150 hPa was sealed as the rare gas in the discharge space. The distance L from the ends of the slender tube portions 8*a* and 8*b* on the side of the discharge space to the ends of the glass frits 12*a* and 12*b* on the side of discharge space was 18 mm in all the cases.

FIG. 3 indicates that when the distance X is 1.8 mm or more, the color temperature change during life is reduced significantly. Thus, when the distance X is a sufficient length of 1.8 mm or more, the ends of the electrode pins 9*a* and 9*b* including a high-temperature positive column and the coils 10*a* and 10*b* can be spaced sufficiently away from the end faces of the slender tube portion 8*a* and 8*b* on the side of the discharge space. This structure permits the temperature in the vicinity of the end faces of the slender tube portions 8*a* and 8*b* on the side of the discharge space to be kept at a temperature at which excessive metal is liquid, so that the amount of the luminous metal that falls down into the slender tube portion 8*a* or 8*b* can be reduced. As a result, the vapor pressure in the discharge tube 1 can be kept at a sufficient pressure so that the characteristics can be stable during lighting.

Figure 4:
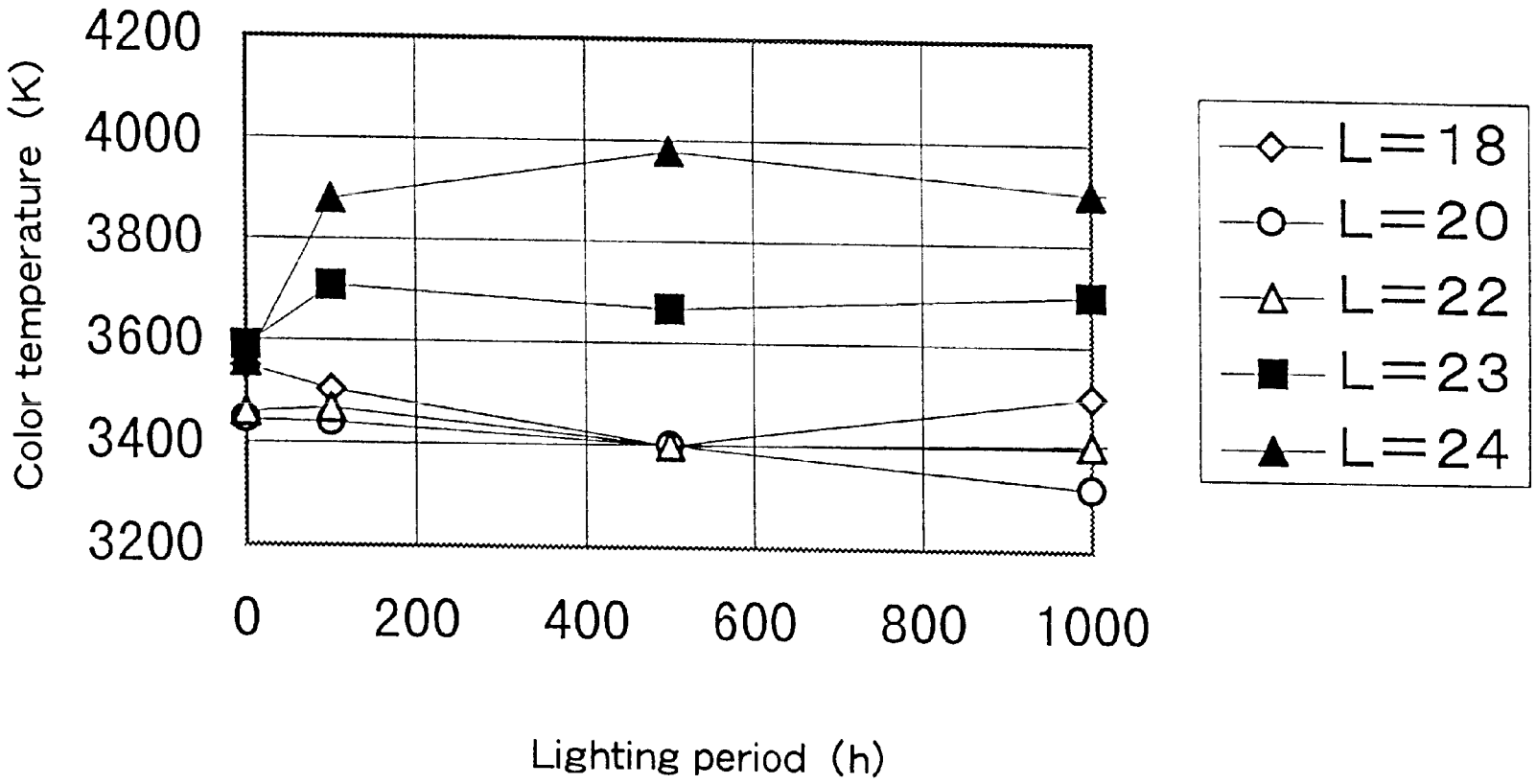
FIG. 4 is a graph showing the color temperature change during lighting when the distance from the end of the slender tube portion on the discharge space side to the end of a glass frit on the discharge space side is changed in the metal vapor discharge lamp (250W) of FIG. 1.

Next, the color temperature change during life in the metal vapor discharge lamp (250W) of this embodiment was measured for each of the distances L from the ends of the slender tube portions 8*a* and 8*b* on the side of the discharge space to the ends of the glass frits 12*a* and 12*b* on the side of the discharge space of 18 mm, 20 mm, 22 mm, 23 mm and 24 mm. FIG. 4 shows the results.

In all of the cases, the amount of luminous metal sealed in the discharge space was 5.2 mg. The composition was as follows: 0.8 mg of $DyI_3$, 0.6 mg of $HoI_3$, 0.8 mg of $TmI_3$, 2.2 mg of NaI, and 0.8 mg of TlI. Argon with a pressure of 150 hPa was sealed as the rare gas in the discharge space. The distance X from the ends of the coils 10*a* and 10*b* on the side of the slender tube portions 8*a* and 8*b* to the ends of the slender tube portions 8*a* and 8*b* on the side of the discharge space was 1.8 mm in all the cases.

FIG. 4 indicates that when the distance L is 22 mm or less, the color temperature change during life is reduced significantly. Thus, when the glass frits 12*a* and 12*b* are present deep into the slender tube portions 8*a* and 8*b*, the volume of the space inside the slender tube portions 8*a* and 8*b* is reduced, so that the amount of the luminous metal that falls down into the slender tube portion 8*a* or 8*b* during lighting can be reduced.

Figure 5:
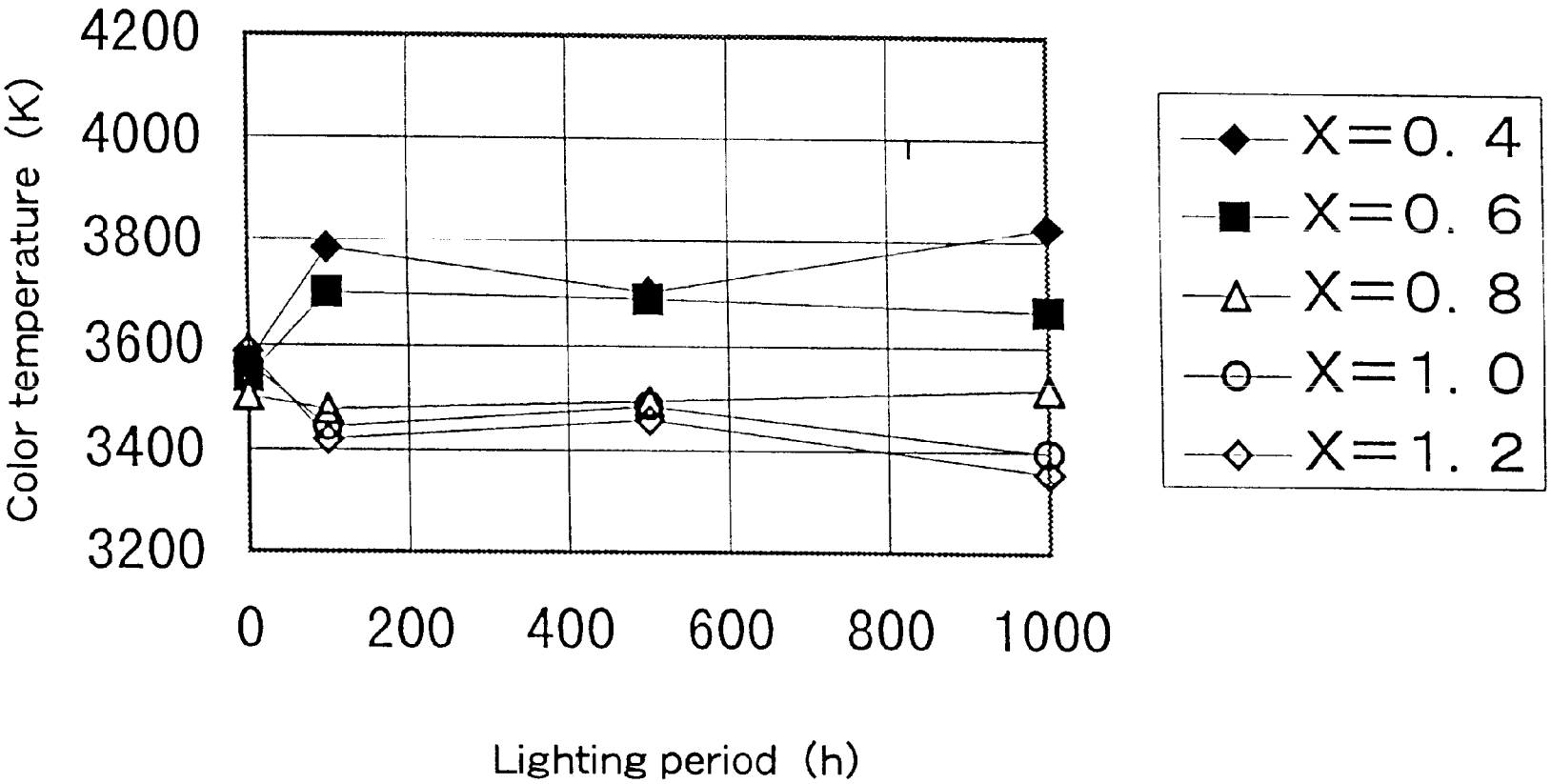
FIG. 5 is a graph showing the color temperature change during lighting when the distance from the end of a coil on the slender tube portion side to the end of the slender tube portion on the discharge space side is changed in the metal vapor discharge lamp (70W) of FIG. 1.

Next, a similar measurement was performed with respect to 70W metal vapor discharge lamps having the structures shown in FIGS. 1 and 2 in the same manner as for the 250W metal vapor discharge lamp. In this case, the color temperature change during life in the 70W metal vapor discharge lamp was measured for each of the distances X from the ends of the coils 10*a* and 10*b* on the side of the slender tube portions 8*a* and 8*b* to the ends of the slender tube portions 8*a* and 8*b* on the side of the discharge space of 0.4 mm, 0.6 mm, 0.8 mm, 1.0 mm and 1.2 mm. FIG. 5 shows the results.

In all of the cases, the amount of luminous metal sealed in the discharge space was 2.5 mg. The composition was as follows: 0.4 mg of $DyI_3$, 0.3 mg of $HoI_3$, 0.4 mg of $TmI_3$, 1.1 mg of NaI, and 0.3 mg of TlI. Argon with 200 hPa was sealed as the rare gas in the discharge space. The distance L from the ends of the slender tube portions 8*a* and 8*b* on the side of the discharge space to the ends of the glass frits 12*a* and 12*b* on the side of discharge space was 8 mm in all the cases.

Figure 6:
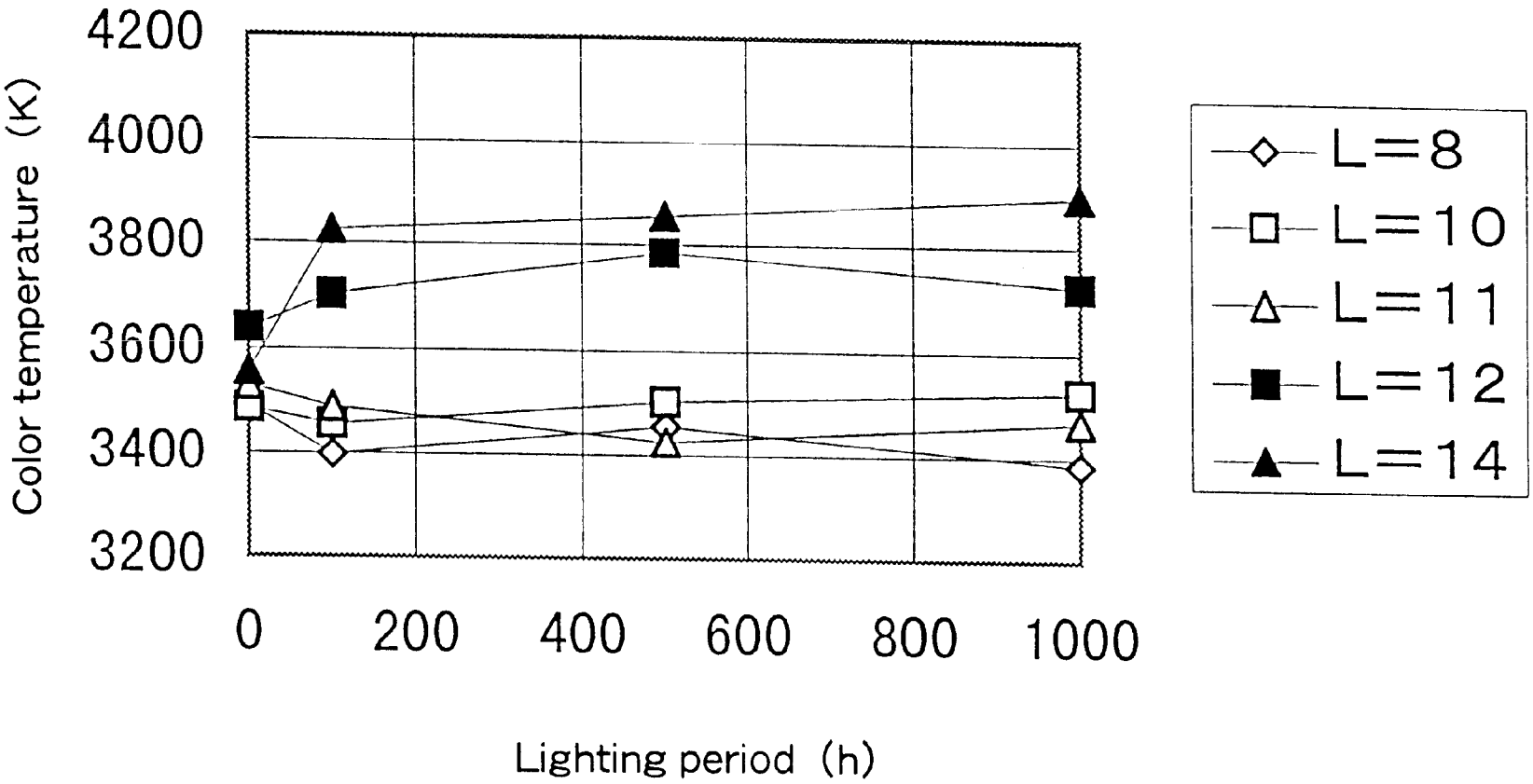
FIG. 6 is a graph showing the color temperature change during lighting when the distance from the end of the slender tube portion on the discharge space side to the end of a glass frit on the discharge space side is changed in the metal vapor discharge lamp (70W) of FIG. 1.

Furthermore, the color temperature change during life in the 70W metal vapor discharge lamp was measured for each of the distances L from the ends of the slender tube portions 8*a* and 8*b* on the side of the discharge space to the ends of the glass frits 12*a* and 12*b* on the side of the discharge space of 8 mm, 10 mm, 11 mm, 12 mm and 14 mm. FIG. 6 shows the results.

In all of the cases, the amount of luminous metal sealed in the discharge space was 2.5 mg. The composition was as follows: 0.4 mg of $DyI_3$, 0.3 mg of $HoI_3$, 0.4 mg of $TmI_3$, 1.1 mg of NaI, and 0.3 mg of TlI. Argon with a pressure of 200 hPa was sealed as the rare gas in the discharge space. The distance X from the ends of the coils 10*a* and 10*b* on the side of the slender tube portions 8*a* and 8*b* to the ends of the slender tube portions 8*a* and 8*b* on the side of discharge space was 0.8 mm in all the cases.

FIG. 5 indicates that when the distance X is 0.8 mm or more, the color temperature change during life is reduced significantly. FIG. 6 indicates that when the distance L is 11 mm or less, the color temperature change during life is reduced significantly. These results are due to the fact that the amount of the luminous metal that falls down into the slender tube portion 8*a* or 8*b* is reduced, as in the case of the 250W metal vapor discharge lamp.

As described above, the color temperature change during lighting can be suppressed when $X>0.0056P+0.394$ is satisfied, where P is a lamp power (W) and X is the distance (mm) from the ends of the coils 10*a* and 10*b* on the side of the slender tube portions 8*a* and 8*b* to the ends of the slender tube portions 8*a* and 8*b* on the side of the discharge space.

Furthermore, the color temperature change during lighting can be reduced further when $L<X\times 20.783P^{-0.0971}$ is satisfied, where L is the distance (mm) from the ends of the slender tube portions 8*a* and 8*b* on the side of the discharge space to the ends of the glass frits 12*a* and 12*b* on the side of the discharge space.

In this embodiment, specific results of evaluating only the 250W and 70W metal vapor discharge lamps are shown. However, for example, also in metal vapor discharge lamps in the range from a low power of 35W to a high power of 400W, when the above two equations are satisfied, the color temperature change during lighting can be reduced.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A metal vapor discharge lamp comprising a discharge tube comprising a translucent ceramic discharge portion that defines a discharge space in which a luminous metal is sealed, slender tube portions provided on both ends of the discharge portion, a pair of electrodes provided with coils at tips thereof, electrode supports that support the electrodes at one end thereof and extend all the way to the ends of the slender tube portions on a side opposite to the discharge space at the other end thereof, and a sealant for sealing the ends of the slender tube portions on the side opposite to the discharge space so as to attach the electrode supports to the inner surfaces of the slender tube portions, wherein $X>0.0056P+0.394$ is satisfied, where P is a lamp power (W) and X is a distance (mm) from the ends of the coils on the side of the slender tube portions to the ends of the slender tube portions on the side of the discharge space.

2. The metal vapor discharge lamp according to claim 1, wherein the sealant extends from the ends of the slender tube portions on the side opposite to the discharge space into the slender tube portions.

3. The metal vapor discharge lamp according to claim 1, wherein $L<X\times 20.783P^{-0.0971}$ is satisfied, where L is a distance (mm) from the ends of the slender tube portions on the side of the discharge space to the ends of the sealant on the side of the discharge space.

4. The metal vapor discharge lamp according to claim 1, wherein the slender tube portions and the discharge portion are made of a same translucent ceramic, and the electrode supports are made of a conductive cermet having a thermal expansion coefficient substantially equal to that of the translucent ceramic.

* * * * *